US010405590B2

(12) United States Patent
Crayton

(10) Patent No.: US 10,405,590 B2
(45) Date of Patent: Sep. 10, 2019

(54) SUN BLOCKING ASSEMBLY

(71) Applicant: Veronica Crayton, Chicago, IL (US)

(72) Inventor: Veronica Crayton, Chicago, IL (US)

( * ) Notice: Subject to any disclaimer, the term of this patent is extended or adjusted under 35 U.S.C. 154(b) by 240 days.

(21) Appl. No.: 15/459,167

(22) Filed: Mar. 15, 2017

(65) Prior Publication Data

US 2018/0263308 A1 Sep. 20, 2018

(51) Int. Cl.
*A41D 13/08* (2006.01)
*A41D 19/00* (2006.01)

(52) U.S. Cl.
CPC ..... *A41D 13/084* (2013.01); *A41D 19/0041* (2013.01); *A41D 2400/26* (2013.01)

(58) Field of Classification Search
CPC .. A41D 13/08; A41D 13/084; A41D 2400/26; A41D 13/0055; A41D 19/0041; A41D 13/088; A41D 13/081; A41D 19/0034; A41D 27/10
USPC ..... 2/59, 125, 126
See application file for complete search history.

(56) References Cited

U.S. PATENT DOCUMENTS 1,117,077 A * 11/1914 Mooney ..... A41D 13/08 2/16
1,796,782 A * 3/1931 Gasperini ..... A41D 13/08 2/16
2,150,069 A * 3/1939 Koleno ..... A41D 13/08 2/59
D299,562 S * 1/1989 Lee ..... A41D 13/08 2/16
5,357,633 A 10/1994 Rael
5,628,062 A 5/1997 Tseng
D398,720 S 9/1998 Lesher, Jr.
5,924,130 A * 7/1999 Fragomeli ..... A41D 13/08 2/16
5,974,586 A 11/1999 Reinosa
6,052,824 A * 4/2000 May ..... A41D 13/08 2/16
6,539,550 B1 4/2003 Flores
6,665,876 B1 * 12/2003 Newman ..... A41D 13/08 2/207
6,775,844 B1 8/2004 Castillo
7,694,348 B1 4/2010 Smith
D649,293 S 11/2011 Lyons
9,936,751 B1 * 4/2018 Mignone ..... A41D 31/0011
2001/0039673 A1 * 11/2001 Carraway ..... A41D 13/08 2/170
2007/0028345 A1 * 2/2007 McCarty ..... A41D 13/08 2/59
2010/0024088 A1 2/2010 Griefer
2010/0083415 A1 4/2010 Beckford
2012/0066810 A1 * 3/2012 Marcus ..... A41D 19/0044 2/16

* cited by examiner

*Primary Examiner* — Amy Vanatta

(57) ABSTRACT

A sun blocking assembly includes a sleeve that is selectively worn on an arm. The sleeve is elongated to extend between a crown of a shoulder and a wrist. The sleeve is comprised of an opaque material to block sunlight thereby inhibiting the sunlight from burning the arm. A drawstring is slidably coupled to the sleeve to tighten the sleeve on the arm. A first elastic member is coupled to the sleeve to tighten the sleeve on the arm. A glove is provided and the glove is selectively worn on a hand. The glove is comprised of an opaque material to block sunlight thereby inhibiting the sunlight from burning the hand.

10 Claims, 3 Drawing Sheets

SUN BLOCKING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to sun blocking devices and more particularly pertains to a new sun blocking device for protecting an arm from sunburn while driving a vehicle.

BRIEF SUMMARY OF THE INVENTION

An embodiment of the disclosure meets the needs presented above by generally comprising a sleeve that is selectively worn on an arm. The sleeve is elongated to extend between a crown of a shoulder and a wrist. The sleeve is comprised of an opaque material to block sunlight thereby inhibiting the sunlight from burning the arm. A drawstring is slidably coupled to the sleeve to tighten the sleeve on the arm. A first elastic member is coupled to the sleeve to tighten the sleeve on the arm. A glove is provided and the glove is selectively worn on a hand. The glove is comprised of an opaque material to block sunlight thereby inhibiting the sunlight from burning the hand.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
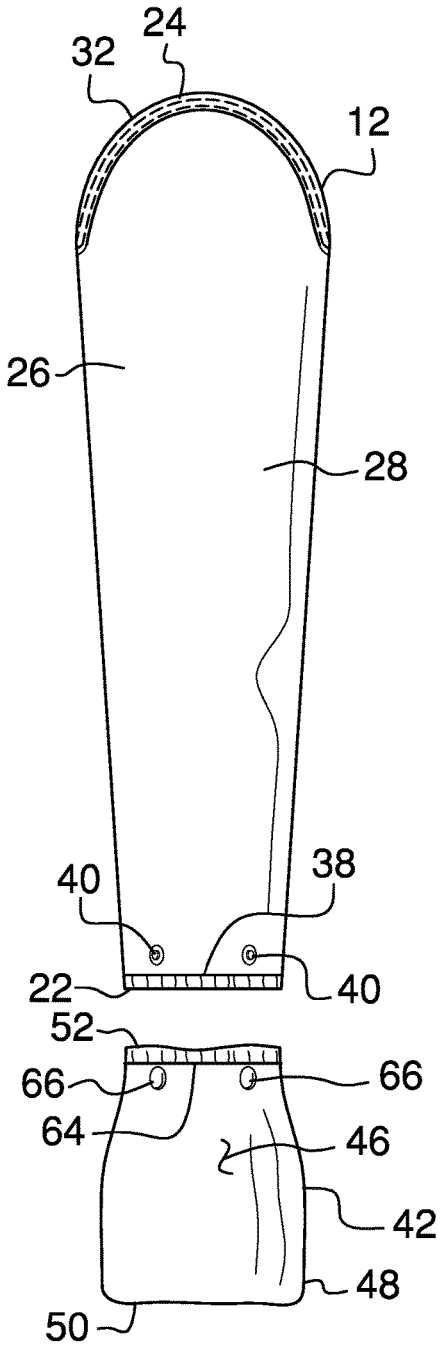
FIG. 1 is a top view of a sun blocking assembly according to an embodiment of the disclosure.
Figure 2:
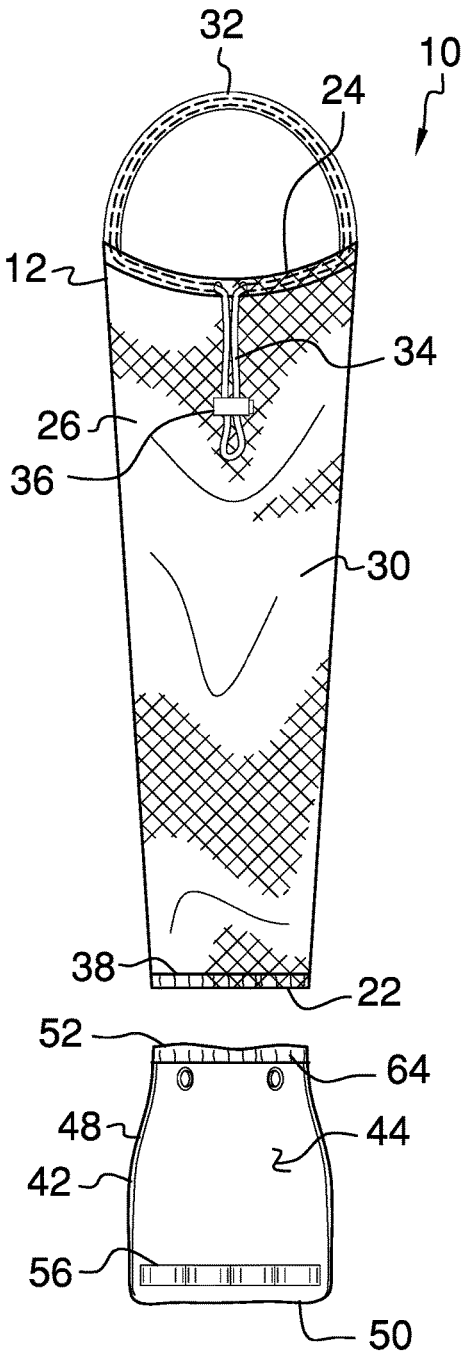
FIG. 2 is a bottom view of an embodiment of the disclosure.
Figure 3:
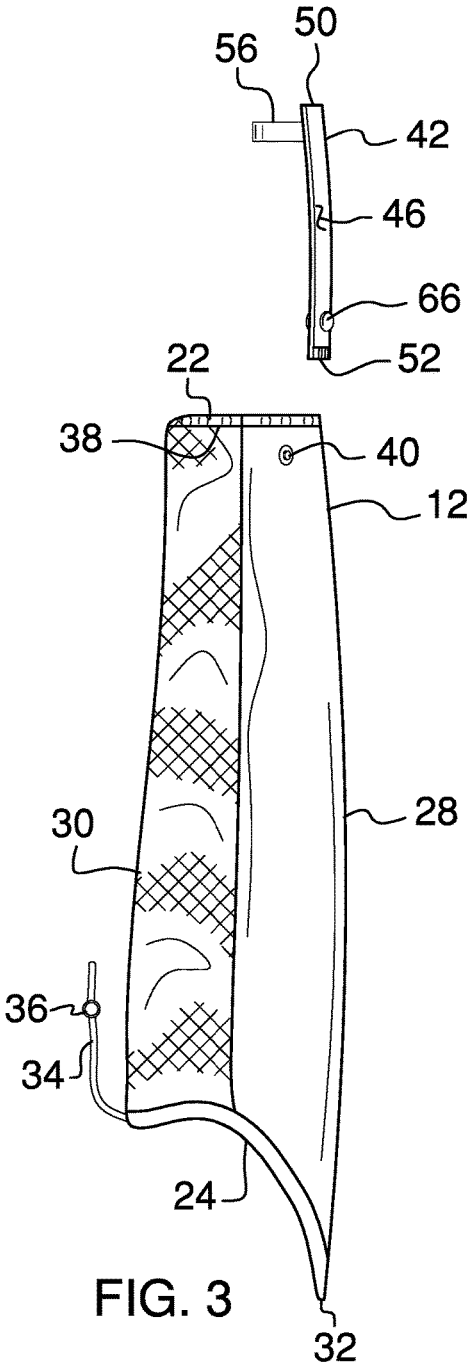
FIG. 3 is a left side view of an embodiment of the disclosure.
Figure 4:
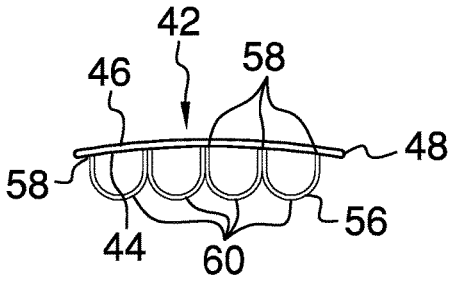
FIG. 4 is a front view of a glove of an embodiment of the disclosure.
Figure 5:
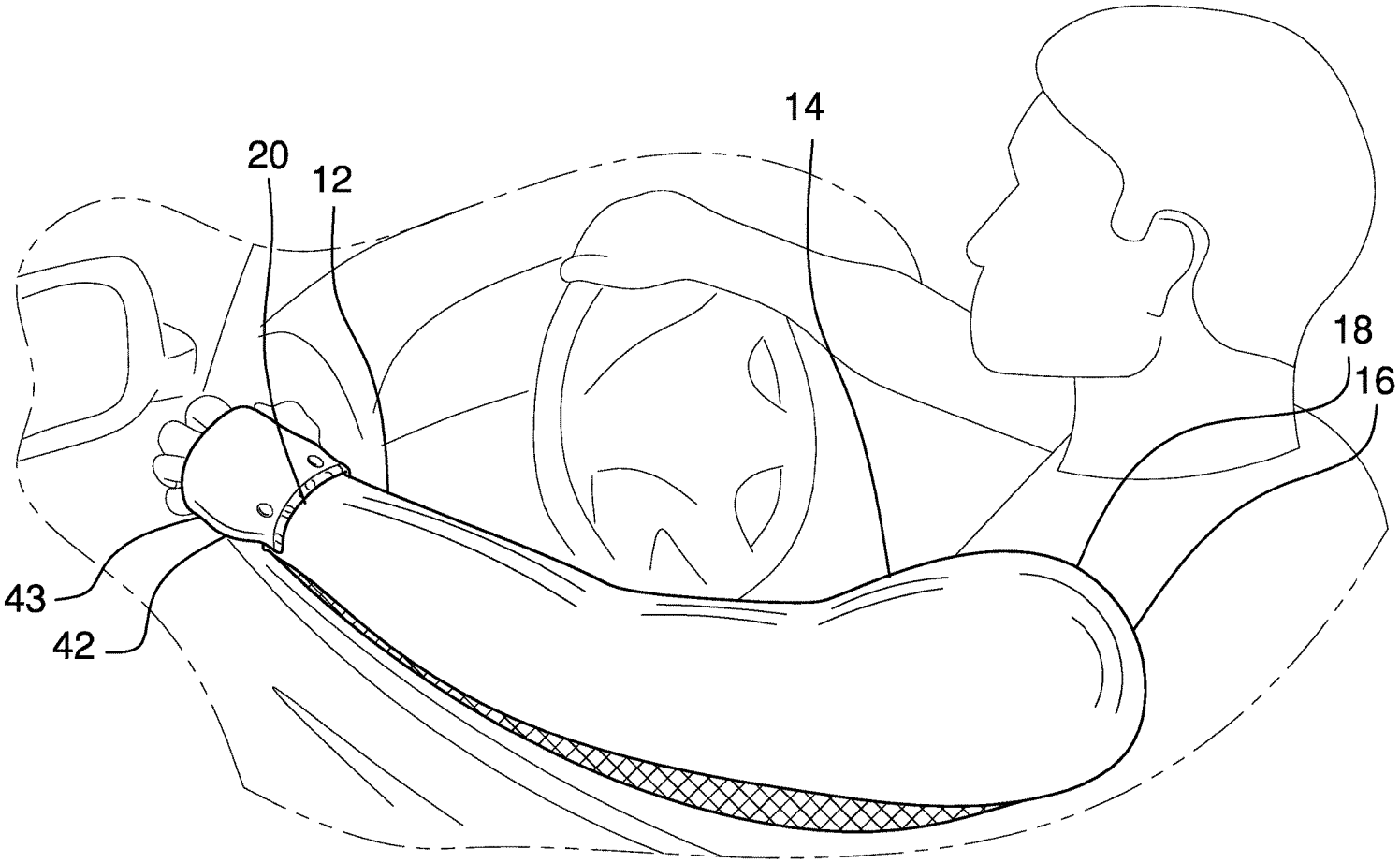
FIG. 5 is a perspective in-use view of an embodiment of the disclosure.

With reference now to the drawings, and in particular to FIGS. 1 through 5 thereof, a new sun blocking device embodying the principles and concepts of an embodiment of the disclosure and generally designated by the reference numeral 10 will be described.

As best illustrated in FIGS. 1 through 5, the sun blocking assembly 10 generally comprises a sleeve 12 that may be worn on an arm 14 of a person driving a vehicle. The sleeve 12 is elongated to extend between a crown 16 of a shoulder 18 and a wrist 20. Moreover, the sleeve 12 is comprised of an opaque material to block sunlight. The person driving the vehicle is positioned next to the driver's side window in the vehicle and the sleeve 12 inhibits the sunlight passing through the driver's side window from burning the arm 14.

The sleeve 12 has a first end 22, a second end 24 and an outer wall 26 extending therebetween. The outer wall 26 has a top side 28 and a bottom side 30. The top side 28 is comprised of an opaque material to block sunlight. The bottom side 30 is comprised of a mesh material to pass air therethrough thereby facilitating the arm 14 to be cooled when the sleeve 12 is worn. The sleeve 12 may have a length ranging between approximately 50.0 cm and 65.0 cm.

The second end 24 corresponding to the top side 28 extends beyond the second end 24 corresponding to the bottom side 30 to define a shelf 32. The shelf 32 extends over the crown 16 of the shoulder 18 when the sleeve 12 is worn. The second end 24 corresponding to the bottom side 30 abuts an armpit when the sleeve 12 is worn. A drawstring 34 is slidably coupled to the sleeve 12 to selectively tighten the sleeve 12 on the arm 14. The drawstring 34 is coextensive with the second end 24 to tighten the second end 24 around the shoulder 18. A lock 36 may be slidably coupled to the drawstring 34 and the lock 36 may inhibit the drawstring 34 from sliding in the sleeve 12 when the second end 24 is tightened around the shoulder 18.

A first elastic member 38 is coupled to the sleeve 12 to tighten the sleeve 12 on the arm 14. Moreover, the first elastic member 38 is coextensive with the first end 22 to tighten the sleeve 12 around the wrist 20. A plurality of first couplers 40 is provided and each of the first couplers 40 is attached to the outer wall 26 of the sleeve 12. Each of the first couplers 40 is aligned with the first end 22 of the sleeve 12 and each of the first couplers 40 is positioned on the top side 28 of the sleeve 12. Each of the first couplers 40 may comprise a snap or other mechanical coupler.

A glove 42 is provided and the glove 42 is selectively worn on a hand 43. The glove 42 is comprised of an opaque material block 36 sunlight thereby inhibiting the sunlight from burning the hand 43. The glove 42 is removably coupled to the sleeve 12.

The glove 42 has a first surface 44, a second surface 46 and a peripheral edge 48 extending therebetween. The peripheral edge 48 has a front side 50 and a back side 52 and the first surface 44 abuts a top side 28 of the hand 43 when the glove 42 is worn. The glove 42 may have a length sufficient to extend between the wrist 20 and knuckles on the hand 43.

A strap 56 is coupled to the first surface 44 of the glove 42 and the strap 56 is oriented collinear with the front side 50 of the glove 42. The strap 56 has a plurality of attachment points 58 with respect to the first surface 44. The attachment points 58 are spaced apart from each other and are distributed along the strap 56 to define a plurality of closed loops 60. Each of the closed loops 60 insertably receives an associated one of the user's fingers 62 when the glove 42 is worn. The strap 56 may be comprised of a resiliently stretchable material to enhance comfort of the closed loops 60 with respect to wearing the glove 42.

A second elastic member 64 is coupled to the glove 42 and the second elastic member 64 is coextensive with the back side 52 of the glove 42. A plurality of second couplers 66 is provided and each of the second couplers 66 is coupled to the second surface 46 of the glove 42. Each of the second couplers 66 is aligned with the back side 52 of the glove 42. Moreover, each of the second couplers 66 removably engages an associated one of the first couplers 40 when each of the sleeve 12 and the glove 42 are worn. In this way the glove 42 is removably coupled to the sleeve 12. Each of the second couplers 66 may be a snap or other mechanical coupler.

In use, the sleeve 12 is worn on the user's right arm 14 when the user is driving the vehicle. The drawstring 34 is manipulated to tighten the second end 24 around the user's shoulder 18. Each of the user's fingers 62 is extended through the associated closed loop on the glove 42. Moreover, each of the first couplers 40 is mated to the associated second coupler. In this way the user's arm 14 and the user's hand 43 are protected from sunburn while the vehicle is being driven.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

The invention claimed is:

1. A sun blocking assembly being configured to be worn on an arm thereby protecting the arm from sun burn, said assembly comprising:

a sleeve being configured to be worn on an arm, said sleeve being elongated wherein said sleeve is configured to extend between a crown of a shoulder and a wrist, said sleeve being comprised of an opaque material wherein said sleeve is configured to block sunlight thereby inhibiting the sunlight from burning the arm, said sleeve having a first end, a second end and an outer wall extending therebetween, said outer wall having a top side and a bottom side, said top side being comprised of a first material being an opaque material wherein said top side is configured to block sunlight, said bottom side being comprised of a second material being a mesh material, said mesh material having a grid defining loose mesh wherein said bottom side is configured to pass air therethrough thereby facilitating the arm to be cooled when said sleeve is worn;

a drawstring being slidably coupled to said sleeve wherein said drawstring is configured to be manipulated thereby facilitating said drawstring to tighten said sleeve on the arm;

a first elastic member being coupled to said sleeve wherein said first elastic member is configured to tighten said sleeve on the arm; and a glove being configured to be worn on a hand, said glove being comprised of an opaque material wherein said glove is configured to block sunlight thereby inhibiting the sunlight from burning the hand, said glove being removably coupled to said sleeve.

2. The assembly according to claim 1, wherein said second end corresponding to said top side extends beyond said second end corresponding to said bottom side to define a shelf wherein said shelf is configured to extend over the crown of the shoulder when said sleeve is worn.

3. The assembly according to claim 1, wherein said drawstring is coextensive with said second end such that said drawstring selectively closes said second end wherein said drawstring is configured to tighten said sleeve around the shoulder.

4. The assembly according to claim 1, wherein said first elastic member is coextensive with said first end wherein said first elastic member is configured to tighten said sleeve around the wrist.

5. The assembly according to claim 1, further comprising a plurality of first couplers, each of said first couplers being attached to said outer wall of said sleeve, each of said first couplers being aligned with said first end of said sleeve, each of said first couplers being positioned on said top side of said sleeve.

6. The assembly according to claim 1, wherein said glove has a first surface, a second surface and a peripheral edge extending therebetween, said peripheral edge having a front side and a back side, said first surface being configured to abut a top side of the hand when said glove is worn.

7. The assembly according to claim 6, further comprising a strap being coupled to said first surface of said glove, said strap being oriented collinear with said front side of said glove, said strap having a plurality of attachment points with respect to said first surface, said attachment points being spaced apart from each other and being distributed along said strap to define a plurality of closed loops, each of said closed loops being configured to insertably receive an associated one of the user's fingers when said glove is worn.

8. The assembly according to claim 6, further comprising a second elastic member being coupled to said glove, said second elastic member being coextensive with said back side of said glove.

9. The assembly according to claim 6, further comprising:

a plurality of first couplers, each of said first couplers being coupled to said sleeve; and a plurality of second couplers, each of said second couplers being coupled to said second surface of said glove, each of said second couplers being aligned with said back side of said glove, each of said second couplers removably engaging an associated one of said first couplers when each of said sleeve and said glove are worn.

10. A sun blocking assembly being configured to be worn on an arm thereby protecting the arm from sun burn, said assembly comprising:

a sleeve being configured to be worn on an arm, said sleeve being elongated wherein said sleeve is configured to extend between a crown of a shoulder and a wrist, said sleeve being comprised of an opaque material wherein said sleeve is configured to block sunlight thereby inhibiting the sunlight from burning the arm, said sleeve having a first end, a second end and an outer wall extending therebetween, said outer wall having a top side and a bottom side, said top side being comprised of a first material being an opaque material wherein said top side is configured to block sunlight, said bottom side being comprised of a second material being a mesh material, said mesh material having a grid defining loose mesh wherein said bottom side is configured to pass air therethrough thereby facilitating the arm to be cooled when said sleeve is worn, said second end corresponding to said top side extending beyond said second end corresponding to said bottom side to define a shelf wherein said shelf is configured to extend over the crown of the shoulder when said sleeve is worn;

a drawstring being slidably coupled to said sleeve wherein said drawstring is configured to be manipulated thereby facilitating said drawstring to tighten said sleeve on the arm, said drawstring being coextensive with said second end such that said drawstring selectively closes said second end wherein said drawstring is configured to tighten said sleeve around the shoulder;

a first elastic member being coupled to said sleeve wherein said first elastic member is configured to tighten said sleeve on the arm, said first elastic member being coextensive with said first end wherein said first elastic member is configured to tighten said sleeve around the wrist;

a plurality of first couplers, each of said first couplers being attached to said outer wall of said sleeve, each of said first couplers being aligned with said first end of said sleeve, each of said first couplers being positioned on said top side of said sleeve;

a glove being configured to be worn on a hand, said glove being comprised of an opaque material wherein said glove is configured to block sunlight thereby inhibiting the sunlight from burning the hand, said glove being removably coupled to said sleeve, said glove having a first surface, a second surface and a peripheral edge extending therebetween, said peripheral edge having a front side and a back side, said first surface being configured to abut a top side of the hand when said glove is worn;

a strap being coupled to said first surface of said glove, said strap being oriented collinear with said front side of said glove, said strap having a plurality of attachment points with respect to said first surface, said attachment points being spaced apart from each other and being distributed along said strap to define a plurality of closed loops, each of said closed loops being configured to insertably receive an associated one of the user's fingers when said glove is worn;

a second elastic member being coupled to said glove, said second elastic member being coextensive with said back side of said glove; and a plurality of second couplers, each of said second couplers being coupled to said second surface of said glove, each of said second couplers being aligned with said back side of said glove, each of said second couplers removably engaging an associated one of said first couplers when each of said sleeve and said glove are worn.

* * * * *